United States Patent [19]

Kramer et al.

[11] Patent Number: 4,610,381

[45] Date of Patent: Sep. 9, 1986

[54] DRYWALL TOOL

[75] Inventors: Francis J. Kramer, Edgewood, Ky.; Lester D. Park; Donald J. Massari, Jr., both of Cincinnati, Ohio

[73] Assignee: Senco Products, Inc., Cincinnati, Ohio

[21] Appl. No.: 646,419

[22] Filed: Aug. 30, 1984

[51] Int. Cl.[4] ..... B25C 1/04; B25C 7/00; F01L 15/14

[52] U.S. Cl. ..... 227/7; 91/267; 91/271; 91/300; 91/321; 91/417 A; 227/66; 227/120; 227/130

[58] Field of Search ..... 227/120, 130, 66, 7; 91/267, 271, 321, 300, 417 A

[56] References Cited

U.S. PATENT DOCUMENTS

| | | | |
|---|---|---|---|
| 2,857,596 | 10/1958 | Allen et al. . | |
| 2,887,686 | 5/1959 | Wandel et al. . | |
| 2,918,675 | 12/1959 | Smith . | |
| 2,997,713 | 8/1961 | Anstett . | |
| 3,027,560 | 4/1962 | Nelson . | |
| 3,040,327 | 6/1962 | Michel . | |
| 3,203,610 | 8/1965 | Farrell . | |
| 3,212,633 | 10/1965 | Dickson . | |
| 3,374,934 | 3/1968 | Dickson . | |
| 3,602,097 | 8/1971 | Dowdall | 91/267 |
| 3,638,532 | 2/1972 | Novak | 91/300 X |
| 3,685,396 | 8/1972 | Obergfell | 91/417 A X |
| 3,774,293 | 11/1973 | Golsch . | |
| 3,971,116 | 7/1976 | Goodsmith et al. . | |
| 4,091,981 | 5/1978 | Moriguchi et al. . | |
| 4,296,672 | 10/1981 | Inhofer | 91/271 |
| 4,341,336 | 7/1982 | Smith | 227/130 X |

OTHER PUBLICATIONS

Fastener Technology, "Taking the Sting from Hand--Held Riveting Guns", Aug. 1983, p. 29.

*Primary Examiner*—Paul A. Bell
*Attorney, Agent, or Firm*—Wood, Herron & Evans

[57] ABSTRACT

A drywall tool provides tactile and audible feedback to the user, as a fastener is driven by frequent multiple blows, to indicate when the fastener is properly driven, and the drywall dimpled, without tearing the paper facing of the drywall. Dimpling apparatus and a firing valve for controlling the multiple blows are described. A cam is provided to withdraw the magazine follower from the last fastener in a strip to avoid jamming or damage by a descending driver. Tool apparatus permits use of lightweight, synthetic parts.

33 Claims, 10 Drawing Figures

DRYWALL TOOL

The present invention relates generally to fastening apparatus and more particularly to pneumatically driven apparatus for driving fasteners into drywall and supporting wood framework.

Drywall is typically fastened to a supporting wood framework, such as studs or joists, by headed fasteners which are driven into the drywall and then into the underlying wood. The particular structure of common drywall makes the driving of such fasteners a delicate process.

Specifically, drywall sheets are normally composed of a crumbly-like gypsum core faced by paper sheets on both sides to form a wall or ceiling panel. When nailing drywall to a supporting structure, it is important that the paper sheet surface remain intact, since tearing or rupture of the paper severly weakens the panel at that point. Such tearing permits the drywall to pull away from the headed fastener since the crumbly gypsum, unsupported by a paper facing, offers little resistance to the fastener or its head.

If the drywall and its underlying wood support were entirely uniform, fasteners could be consistently placed in the drywall and wood support without the head tearing the paper. Such material uniformity, however, seldom exists at the construction site. Variances in wood type, moisture, knots and the like require substantially different forces for fastener driving. Where soft wood underlies a fastener position, a fastener is fully seated with only light driving forces. Harder wood or knots require application of much heavier forces for similar results. Also, if a stud or joist is missed, for example, application of anything but the lightest reasonable force will drive the fastener head through at least the facing paper sheet, tearing it.

It is thus clear that use of a uniform driving force for each fastener will only produce varied, generally undesirable overall results. Some fasteners will be fully driven, some will be driven through the drywall, and some will not be driven deeply enough.

The process of manually driving fasteners with a hammer provides both audible and tactile feedback through the hammer, and a user has time between blows for adjustment so the fastener can be fully driven but without tearing a facing sheet. Even where such fasteners are manually driven, however, at least some tears occur. When the same process is mechanically done, such as with a pneumatically powered drywall tool, these tactile and audible feedbacks are generally not available. Moreover, a user normally does not have the time during the driving operation, which may be one full stroke, to adjust the tool in response to the drywall and wood characteristics at that location. Paper fastener driving consistency is thus difficult, at best, to obtain.

Apart from not tearing the paper face of the drywall, it is also desirable to sink the fastener head in the drywall to a position level with or below the paper surface. This permits the head to be covered with a finish coating so that a smooth wall or ceiling surface, without fastener protrusions, is produced. While the drywall can be dimpled to provide a depression in the paper for receipt of a fastener head, it is difficult to manually produce consistently deep and uniform dimples without tearing of the paper face.

Consistent and uniform dimples are also difficult to produce with mechanical apparatus such as pneumatically driven drywall fastener tools. Since known tools generally operate to dimple at the end of a fastener drive cycle, and since dimpler impact is usually limited by, or is a function of, a resilient bumper or fastener position, the same underlying material inconsistencies hinder uniform results and produce more paper tearing or insufficiently driven fasteners than necessary.

In another aspect of the typical single-blow pneumatic drywall fastener tool, it is appreciated that the drive components must be accelerated in order to drive the fastener, and dimple the drywall. This results in appreciable and undesirable recoil. One response to this has been to increase the tool weight to dampen recoil. Such increases are highly undesirable, however, from the standpoint of a user who must carry and lift the gun for long periods. He is thus faced with periodic heavy recoil, or a constantly heavy tool.

Moreover, the high fastener velocities generated during single blow driving tend to damage the surrounding wood fibers, reducing the wood's capacity to hold the driven fastener. This results in more "nail pops" where the fastener, after a time, protrudes outwardly of the drywall surface.

While it has been heretofore suggested to use a tool producing multiple blows to drive a fastener in other mediums or applications, there is no presently known disclosure or suggestion that a multiple-blow tool could be advantageously used to drive fasteners in drywall. Furthermore, and whether or not multiple-blow tools have been suggested in this application, the known multiple-blow fastener devices incorporate certain disadvantages. Specifically, they require either manual operation for each blow, partial tool retraction between blows, or valving systems requiring multiple operating movements, or complex structures with heavy parts for handling high pressure air and the stresses generated by large mass reciprocating components.

Moreover, the utilization of known single-blow pneumatic drywall tools involves numerous functional disadvantages with respect to consistent and uniform fastener driving. First, known single-blow tools are generally pre-set to deliver a predetermined blow to drive a fastener. Not only does this have the capacity to be too much, causing paper tearing as mentioned above, or too little, resulting in a protruding fastener, but such known units provide little, if any, useful feedback to the operator during the driving of a specific fastener. He thus cannot initiate useful driving force changes to account for changes in the condition of the underlying drywall support structure for that fastener.

While certain multiple-blow tools have been suggested for driving fasteners in general, the known ones do not provide desirable uniform fastener driving and dimpling as desired for a consistent fastener setting for each fastener used in drywall.

In the manufacture of fastener driving tools, it is common to supply housings and internal components of metal to withstand high air pressures and operating stresses, such as recoil stresses, normally encounted in the driving operation. These metallic components are generally strong, but do have significant weight, and require expensive machining. Heretofore, this weight has not been considered to constitute a significant problem due to its usefulness in dampening recoil. Such weight would be highly undesirable if the recoil problem were solved, but the need to withstand high pressure air and energy stresses, for example, would still require the use of heavy structural material such as an appropriate metal. This generally increases the weight and manufacturing expense of such a tool despite a need to make it as light and as inexpensive as possible.

In yet another aspect of fastening drywall to supporting structures, when fasteners, such as nails, are used, it is generally desirable to utilize large fastener heads for maximum holding power. Larger heads spread the retention forces over a larger area of the paper face than relatively smaller fastener heads. Thus, it is preferably to use nails, for example, having large round or full heads, as opposed to "T"-headed nails, crescent-headed nails, or the like, which may be more prone to tear the paper.

The use, however, of full-headed nails presents special problems where the nails are to be supplied to a pneumatic fastener tool magazine in strips. Specifically, it is generally necessary to bias the strip forwardly and toward a drive position, beneath a drive plunger or blade, by using a pusher engaging the shank of the last nail in the strip. When the last nail in the strip is positioned at the drive position, the drive plunger will move forwardly and could cause the nail head to hit the pusher, or would itself hit the pusher. This would break parts of the apparatus and at best cause binding or jamming of the parts.

It has thus been one objective of the invention to provide an improved tool for uniformly driving fasteners into drywall without paper tearing and despite structural material variations.

A further objective of the invention has been to provide an improved pneumatic drywall tool for driving and seating fasteners into drywall and providing audible and tactile feedback to the operator to enable consistent fastener driving and seating without paper tearing.

A further objective of the invention has been to provide an improved drywall fastener tool for uniformly driving fasteners into drywall and dimpling drywall for receipt of fastener heads.

A further objective of the invention has been to provide a light weight drywall tool for driving fasteners without undesirable tool recoil.

A further objective of the invention has been to provide an improved drywall tool for driving fasteners into drywall and having improved fluid valving for operating the tool.

It has been a yet further objective of the invention to provide a drywall fastener tool of reduced weight and reduced manufacturing expense, yet which will sustain the high pressures and stresses of driving operations.

It has thus been a further objective of the invention to provide an improved pneumatic drywall tool and associated magazine for handling a nail supply comprising a plurality of full-headed nails, and permitting the operative driving of every nail in the supply into drywall without breaking, binding or jamming of tool or magazine parts.

To these ends, a drywall fastener tool according to a preferred embodiment of the invention includes a limited stroke driver which is repetitively engaged and driven by a reciprocating free piston to provide successive limited stroke blows to a full-headed drywall fastener. The utilization of such a tool provides to the user both tactile and audible feedback to enable the user to consistently drive full-headed fasteners into drywall and to a uniform depth without tearing the paper sheeting on the drywall and despite variations in the underlying or supporting wood structure. As a result of the very limited driver stroke, and the frequency of the repetitive drive, a user both feels forces imparted by the tool and hears the sounds of the fastener driving, both of which perceptions indicate the position of the fastener and its full head with respect to the drywall. With very little training and practice, a user can thus uniformly set full-headed fasteners into drywall without undesirable tearing or rupture of the paper sheet covering the drywall.

The forward end of the tool is provided with a nose section having a dimpler surface surrounding the fastener as it is driven. The rear end of the dimpler structure is positioned so that a forward shoulder on the driver engages the dimpler structure as the fastener is finally driven, thus providing a dimple or recess for receipt of the full head of the fastener at the same time the fastener is finally set into the drywall and the underlying structure. The tactile and audible feedback perceived by the user as the fastener is finally set is thus a function of the operation of the fastener tool on the fastener as it is driven and, as well, of the engagement of the forward end of the tool during the dimpling process as the fastener is finally set.

Since the fastener driver is not connected directly to the reciprocating piston, there is less reciprocating mass in the drywall tool and thus less perceived recoil, the entire operation being prefaced upon multiple, lower energy, short stroke blows rather than fewer and longer strokes.

In addition to the reduction of recoil, the utilization of this structure, combined with the short driver stroke, accomplishes fastener driving with a much slower fastener drive velocity. Such a slower fastener drive velocity does not tend to disturb and damage wood fibers immediately surrounding the fastener as would a much higher fastener velocity produced by a single blow fastener tool, for example. Accordingly, the slower fastener drive velocity tends to set a fastener in an underlying wood support of the drywall in a much more secure manner and the wood fibers tend to hold a fastener so driven much more firmly than a fastener driven with substantially increased velocity.

A drywall tool, according to a preferred embodiment of the invention, is actuated by the engagement of the forward end of the tool against a drywall surface and the continued pressing of the tool against the surface. The nose section of the tool is mounted for movement with respect to the rear end or handle of the tool. An actuating rod attached to the nose section extends rearwardly and is disposed in a tool housing in order to actuate a pneumatic circuit for reciprocating the driving piston within the tool. It is unnecessary to provide a manual trigger to produce each successive blow, since the firing valve of the preferred tool accomplishes the successive repeated piston motions without repeated manual actuations of the firing valve or any part of the controlling pneumatic circuit. When the fastener is finally set, as determined by audio and tactile feedback, the tool is simply pulled back away from the drywall.

As a result of the reduced recoil provided by the preferred embodiment of the invention, and in order to reduce the weight of the drywall tool, a number of components of the preferred embodiment of the invention are manufactured from a synthetic material such as plastic or other resins. The use of these synthetic lightweight materials is made possible by the provision of a reduction in a reciprocating mass of the tool. In the tool housing and except for several minor parts, only the piston, the cylinder in which it reciprocates, the driver, the actuating rod, and the stem of the firing valve, as will be described, are manufactured from metallic parts. The remaining component parts including the tool housing, the firing valve housing, and the cylinder head or manifold plate are made from a lightweight resinous material, thus producing a drywall tool of lightweight construction together with significantly reduced perceived recoil as compared, for example, to single-blow drywall tools or to multiple-blow tools of any known type.

A firing valve according to a preferred embodiment of the invention includes a reciprocating core with seals mounted thereon for sealing and venting respective valve chambers for causing piston reciprocation within the tool cylinder. The firing valve provides a control for positively reciprocating the piston, and yet is easily accessible within the tool for seal replacement and valve maintenance.

In addition to the above features, a drywall tool according to the preferred embodiment of the invention is provided with apparatus for utilizing full-headed nails without being susceptible to any binding or jamming as a result of the fastener driver engaging the magazine structure for feeding full-headed nails to a driving position. Specifically, and according to a preferred embodiment of the invention, the nail feed apparatus includes a magazine adapted for receipt of a plurality of nails preferably supplied in a strip and held together, for example, by tape or other securing means. A pusher engages the last nail in the strip and biases the entire strip toward the drive position so that nails are successfully fed from the forward end of the strip into a drive position for fastener driving. Preferably, the nail to be driven has its full head lying just under the head of the next nail so it does not interfere therewith.

Once the next to the last fastener in the strip has been driven, the drywall tool is pulled away from the drywall surface and is then pressed against another portion of the surface for driving the final fastener, which has been urged into the drive position by the pusher. As the tool is pressed toward the drywall surface, the tool housing is moved forwardly with respect to the nose section of the tool. A cam surface on the housing engages a laterally extending cam follower projecting from the strip pusher and shifts the pusher away from the last fastener to be driven, just as the tool is actuated to drive the fastener with its first blow. Accordingly, the strip pusher is retracted from the path of the driver and the fastener head prior to the driving of the fastener so as to avoid engagement of the fastener head or the driver with the pusher.

A preferred embodiment of the invention thus provides an improved drywall tool of relatively light weight and capable of providing both tactile and audible feedback to the user so that full-headed fasteners can be driven in the drywall and the heads set level with, or below, the surface of the paper sheet of the drywall without paper rupture or tearing and despite variations in the characteristics of the underlying wood support on the drywall itself. As a result of the limited driver stroke and stroke frequency, a user can determine when a fastener has been properly set, even in cases where a fastener misses any underlying wood support at all and thus tearing or rupture of the paper sheet of the drywall is eliminated, despite the characteristics of the underlying wood support or the missing of such a support with the fastener.

These and other features and advantages will become readily appreciated from the following description of a preferred embodiment of the invention and from the drawings in which.

Reference will now be made in detail to a preferred embodiment of the invention as illustrated in the accompanying drawings.

Figure 1:
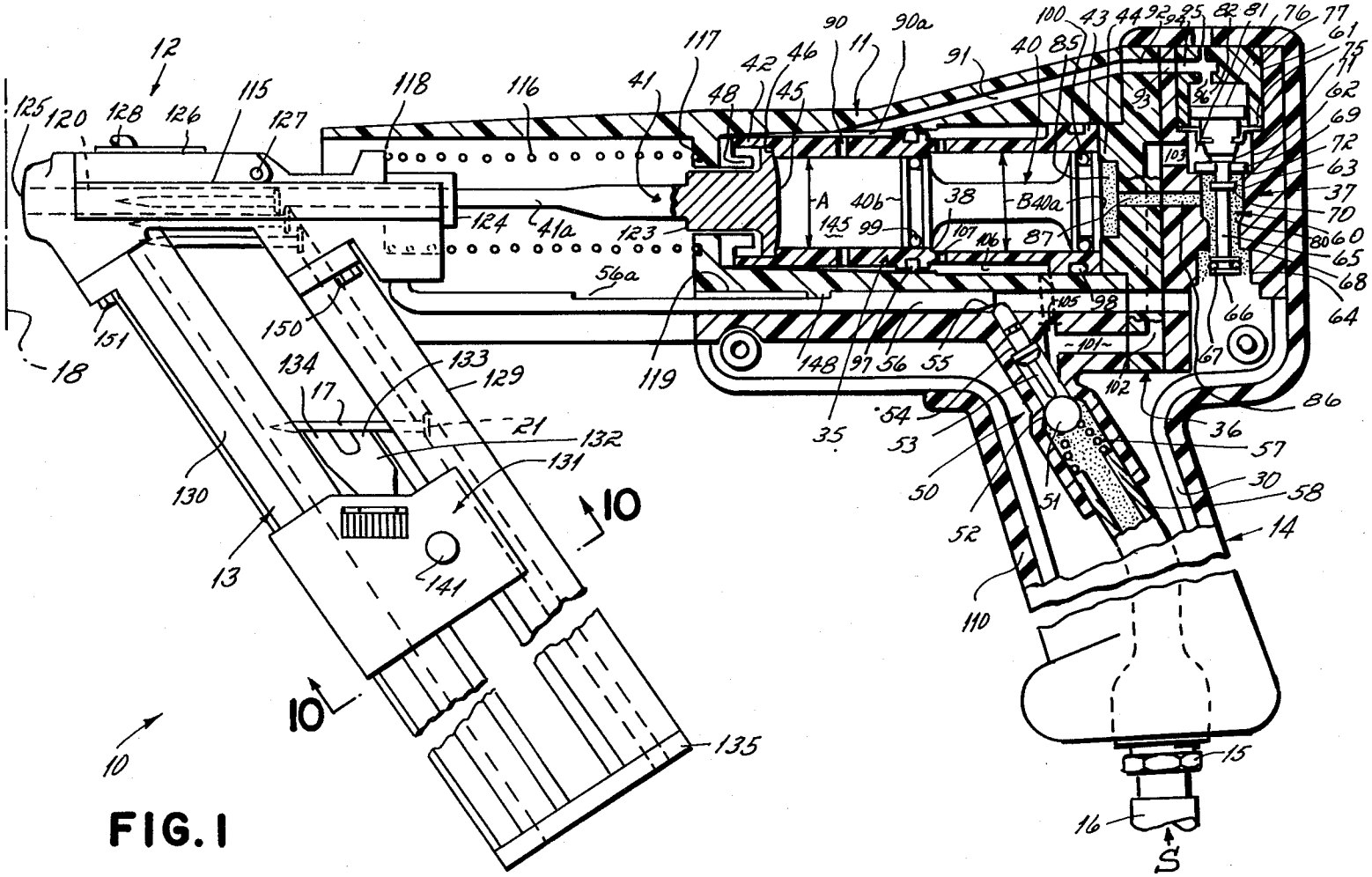
FIG. 1 is a cross-sectional, elevational view of a preferred embodiment of the drywall tool according to the invention, and showing the tool in its at-rest or idle position.

In FIG. 1 is illustrated a preferred embodiment of a drywall tool 10 including a tool housing 11, a nosepiece 12 movably mounted on housing 11, and a fastener magazine 13. A handle 14 supports the tool 10 at the rear end of the housing 11 and a pneumatic coupling 15 is provided on the handle 14 for receiving a pneumatic conduit 16 as shown. Alternatively, conduit 16 and coupling 15 could be operatively provided at another position on the housing 11. Conduit 16 is operably connected to a source S of compressed air.

Figure 5:
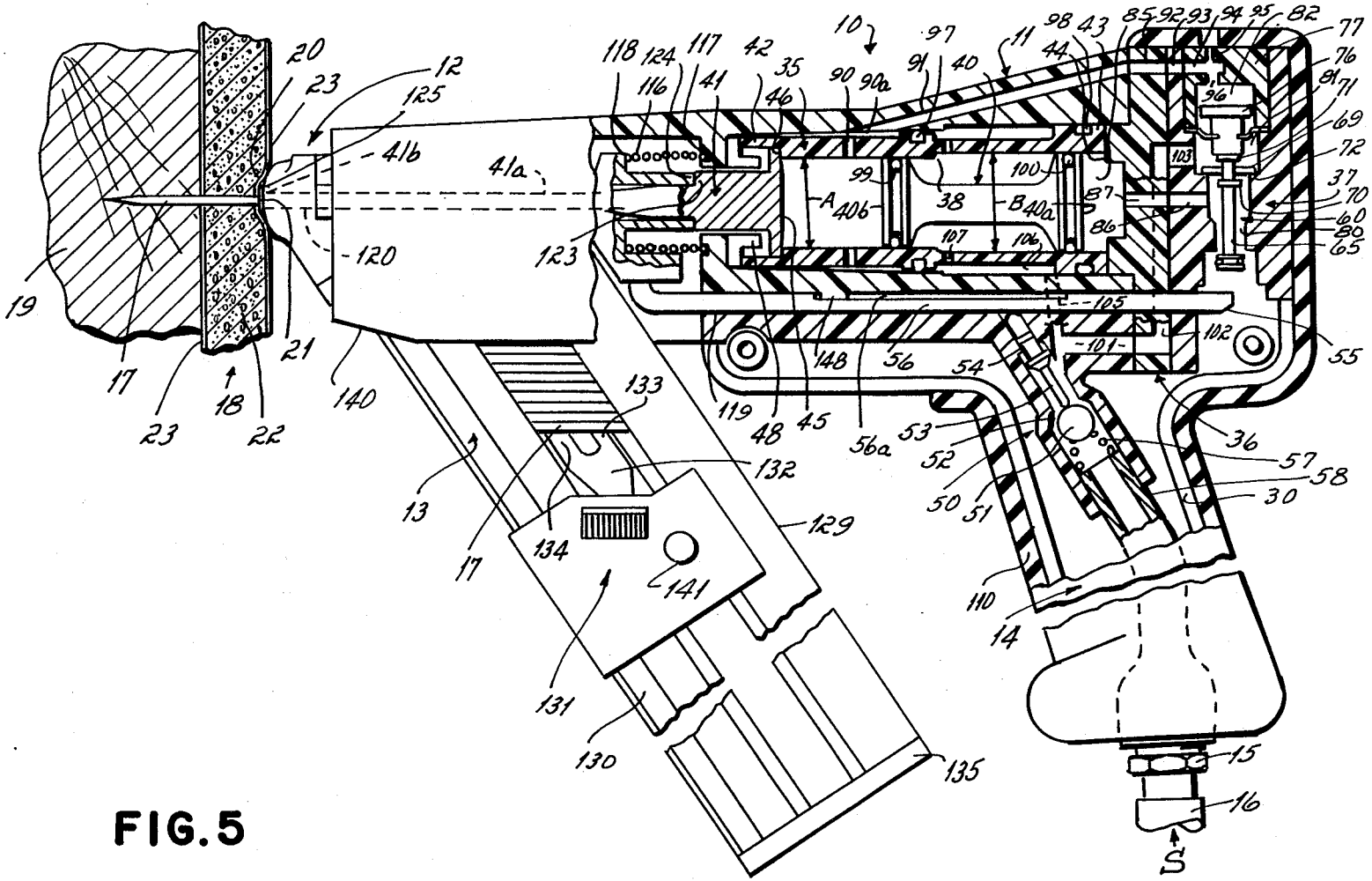
FIG. 5 is a view similar to FIG. 1, however showing the tool in its fully driven position with the driver having engaged the nosepiece to form a dimple in the drywall, the drywall being shown with an underlying wood support.

It will be appreciated that the tool 10 is particularly adapted to uniformly drive full-headed fasteners 17 (FIG. 5) into drywall panels 18 and into the underlying wood support 19 therefor, despite the characteristics of the wood support 19, such as moisture content, hardness, knots, etc., and whether or not a wood support is actually hit or missed by the fastener 17. At the same time, the tool produces a dimple 20 in the drywall for receipt of the full heads 21 of the fasteners 17. As shown in FIG. 5, the fastener 17 has been properly driven so that the head 21 lies within the dimple 20 without tearing the paper facing 23.

Such uniform fastener driving and drywall dimpling is accomplished by driving the fastener with successive, short strokes and forming the dimple 20 as the fastener is finally set. The apparatus for producing the successive short strokes, coupled with the other tool components, produces tactile and audible feedback to a user so that he can tell when the fastener 17 is properly set and back the tool away from the drywall 18 without tearing any facing component of the drywall.

In this connection, it will be appreciated that the drywall 18 comprises a crumbly-like gypsum core 22

(FIG. 5) and paper facing sheets 23, reinforcing and forming the composite drywall panel 18. Any tearing of the paper facing 23, such as by a fastener head 21, weakens the drywall panel 18 and permits it to pull away from a fastener. The gypsum core, unsupported by only torn paper facing, offers little resistance for the fastener or its head.

Returning now to FIG. 1, the various components of the drywall tool 10 will now be described. As hereinafter noted, the tool 10 is preferably pneumatically driven. Other drive media or means could be used alternatively.

The housing 11 preferably comprises a molded housing of the configuration as shown and manufactured from a synthetic material, such as any suitable resinous plastic material. The handle 14 includes handles halves 30 which are joined together to form the handle 14 and which, in effect, comprise an integral portion of the housing 11.

Within housing 11 is mounted a cylinder 35, a cylinder head or manifold plate 36 and a firing valve housing 37. A piston 40 is disposed within the cylinder 35 and a driver 41 is mounted for limited movement at the forward end 42 of the cylinder 35, as will be hereinafter described.

The piston 40 is mounted for reciprocation between the forward end 42 of the cylinder 35, and the rearward end 43 of the cylinder 35. Cylinder 35 also includes a beveled annular step 38 which defines a change from a lesser diameter A in a forward portion of cylinder 35 to a larger diameter B in the rearward portion of cylinder 35 for purposes which will hereinafter be explained. As will be appreciated, the ends of piston 40 are sized to approximately fit within their respective portions of cylinder 35. Essentially, piston 40 moves between the manifold plate 36, at the cylinder's rear end 43 and the strike face 45 of the driver 41. Of course, a separate, resilient buffer (not shown) could be used to cushion the rearward stroke of the piston 40. The rearward movement of the driver 41 is limited by an annular shoulder 46 at the forward end 42 of the cylinder 35, and the forward driver stroke is limited by an annular stop 48 mounted at the forward end 42 of the cylinder 35. It will be appreciated from the drawings that the stroke of the piston 40 is substantially larger than the stroke of the driver 41 which is very limited. Specifically, the driver stroke, for example, is preferably about 1/16", while the piston stroke is about 1-⅛". It will also be appreciated that the stroke of the driver 41 is much less than the length of the fastener 17, as can be seen from the figures. Fasteners 17 are typically about 1-¼" to about 1-½" in length, for example. While the piston is reciprocated by air pressure, as will hereinafter be described, it is to be appreciated that the driver does not move with the piston, except upon being struck thereby. It thus does not add to the reciprocating mass of the piston.

Similarly to housing 11, handle 14, manifold plate 36 and the firing valve housing 37 are also manufactured of synthetic material such as a suitable resinous or plastic material. These lightweight synthetic parts permit a very lightweight tool 10.

Within the handle 14 is located a control valve 50, comprising ball valve 51 operatively associated with the valve seat 52. The valve 50 also includes a valve stem 53 for engaging the ball 51 to unseat it from seat 52. Valve stem 53 is reciprocably mounted in bore 54 in such a position as to be engaged by the cam surface 55 of an actuator rod 56. A spring 57 normally urges the ball 51 against seat 52 to close the control valve 50 against high pressure fluid in a conduit 58.

A firing valve 60 is provided within the firing valve housing 37. The firing valve housing 37 is provided with a bore having varying diameter bore portions 61, 62, 63 and 64. A valve stem 65 is disposed within the various bore portions 61–64. At the lower end 66 of the valve stem 65, an O-ring seal 67 is secured for cooperation with a stepped down bore 68 disposed between the larger bore portions 63 and 64. A translating seal 69 is mounted on a mid-portion of the valve stem 65 for translation between a pair of annular stops or flanges of stem 65. Seal 69 cooperates with a seat 72 provided generally between the bore portions 62 and 63. At the top end of the valve stem 65, a rolling diaphragm 75 is secured between the valve stem and the bore portion 61 of the firing valve housing 37. The diaphragm is secured to the valve stem by means of a nut 76 on the valve stem 65 and by means of a ported cap 77 secured within the bore portion 61 of the valve housing 37.

For purposes of description, the firing valve housing 37 defines a first pressure zone 80, a second pressure zone 81 and a third pressure zone 82. First pressure zone 80 is generally defined partially by bore portion 63. Second pressure zone 81 is generally defined in bore portion 62. Third pressure zone 82 is generally defined by ported cap 77 in bore portion 61 and above rolling diaphragm 75.

The firing valve 60 and the various pressure zones 80–82 are operatively and respectively connected to various operating chambers which are associated with the piston 40 and the cylinder 35 by means of the manifold plate 36. In particular, the first pressure zone 80 is connected to an expansion chamber 85 behind the rearward end **40*a* of the piston 40 by means of a passageway 86 in the firing valve housing 37 and a passageway 87 in the manifold plate 36**.

The third pressure chamber or zone 82 above the diaphragm 75 is connected to ports 90 in the cylinder 35 by means of recess **90*a* and passageway 91 within the housing 11, passageway 92 within the manifold plate 36, passageway 93 within the firing valve housing 37, and passageway 94 within the ported cap 77. Passageway 94 operatively connects with vent passage 95 and with pressure passage 96 within the gap 77 to the pressure zone 82**.

In addition, it will be appreciated that the firing valve is operatively connected to a source "S" of pressurized fluid such as compressed air through the control valve 50 and as diagrammatically illustrated in FIG. 1. Particularly, the housing 11 also includes a passageway 101, passageway 102 in manifold plate 36 and passageway 103 in firing valve housing 37 connected with the second pressure zone 81.

It will also be appreciated that the control valve 50 is connected through passageway 105 to recess 106 between the cylinder 35 and housing 11. Recess 106 is ported interiorly of the cylinder by ports 107.

Further, it will be appreciated that cylinder 35 is sealed within housing 11 by means of O-rings 97, 98 while piston 40 includes O-rings 99, 100 to provide a seal between ends **40*b*, 40*a* to seal chamber 145 from communication with the rest of cylinder 11**.

Finally, it will be appreciated that the handle 14 and portions of the housing 11 are covered by an appropriate resilient covering 110, protecting the tool 10 from damage and insulating operating vibrations from the operator grasping the handle 14.

Nosepiece 12 is mounted to the housing 11 by means of elongated guides 115 riding within correlating elongated recesses (not shown) within the housing 11. Nosepiece 12 is resiliently biased forwardly of the housing 11 by means of a spring 116 supported between shoulder 117 of the housing 11 and a rearward shoulder 118 of the nosepiece 12.

Actuator rod 56 extends rearwardly from the nosepiece 12 and through a bore 119 within the housing 11 for operating the control valve 50, as has been described.

The nosepiece 12 includes a fastener device channel 120 of sufficient size for permitting passage of a fastener 17, together with the full fastener head 21, through the nosepiece 12 and into position with respect to the drywall 18 and the underlying wood support 19. It will be appreciated that the length of drive channel 120 is greater than the length of a fastener 17 for purposes which will become apparent.

In this regard, the driver 41 is provided with a forwardly extending driver blade **41*a* which extends forwardly of the strike surface or face 45 and into the nosepiece 12 and the channel 120. It is the driver blade 41*a* and crescent-shaped forward end 41*b* thereof (FIG. 9) which engages the head 21 of the fastener 17 for driving the fastener once the tool 10** is pressed against the drywall surface, as will be described.

The driver 41 also includes a forwardly facing dimpling or drive shoulder 123 for engaging a dimpling drive surface 124 on the rearward end of the nosepiece 12. The forward end of the nosepiece 12 is provided with a dimpling surface 125 for engaging and producing a recess or dimple 20 within the drywall 18 (FIG. 5). Accordingly, when the dimpling drive shoulder 123 of the driver 41 engages the dimpling drive surface 124 of the nosepiece 12, a forward stroke of the driver 41 is operable to drive the dimpling surface 125 of the nosepiece 12 against drywall 18 to produce a dimple 20.

The nosepiece 12 also includes a pivoted jam-clearing gate such as backing plate 126, pivoted about pivot pin 127. Plate 126 defines a portion of the fastener drive channel 120. The backing plate 126 is latched by a spring-operated latch means 128 normally biased in a forward direction in the position as shown in FIG. 1. When the latch 128 is moved to the right or rearwardly, as shown in FIG. 1, the entire pivoted backing plate 126 can be pivoted around pivot 127 to open the fastener drive channel to clear any jams which might exist.

Figure 10:
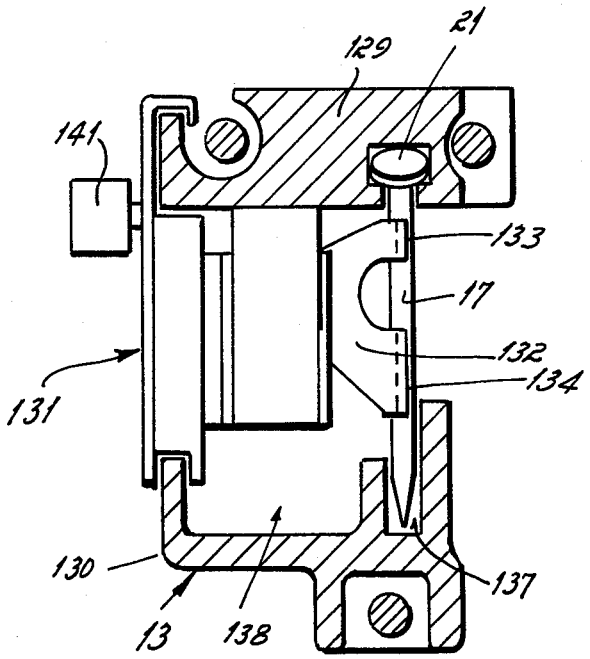
FIG. 10 is a cross-sectional view taken along lines 10—10 of FIG. 1.

A fastener supply magazine 13 is mounted on and secured to the nosepiece 12 for movement therewith relative to the housing 11. The magazine 13 is primarily comprised of elongated body members on spaced apart ways 129, 130 and a spring driven pusher 131. Upper and lower body members 129, 130 define a path 138 for pusher 131, and a magazine channel or path 137 for a full-headed fastener 17, as can be best seen in FIG. 10. It will also be appreciated that the magazine 13 includes an end cap 135 having a T-shaped opening therein in alignment with magazine channel 137 for holding the fasteners.

Figure 9:
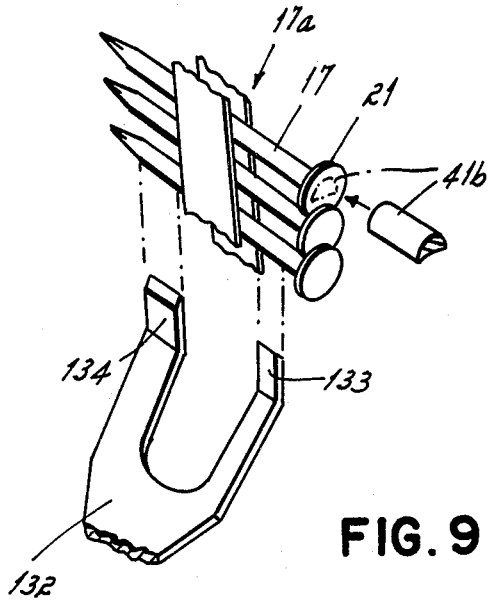
FIG. 9 is an illustrative perspective view showing a preferred strip of full-headed fasteners and the relationship of the fastener driver and pusher.

The spring driven pusher 131 includes a feeder shoe 132 having bifurcated ends 133, 134 movably disposed in path 137 for engaging the last fastener in a supply strip **17*a* of fasteners 17. The fasteners 17 are typically provided for loading in the magazine 13 in strip form, wherein each of the fasteners are secured in a strip by means such as tape, for example, which hold the fasteners together until they are separated from the strip by the driving of the end fastener. Such a supply of fasteners, together with a relative shape and position of the driver blade 41*a* is shown in FIG. 9** where the full heads of the fasteners are each disposed against a following fastener shank.

It should be appreciated that the shoe 132 is preferably pivotally mounted on the pusher 131 for motion in a lateral direction with respect to a strip of fasteners located within the magazine 13 and thus with respect to channel 137.

In this regard, the magazine 13 is provided with the spaced apart ways 129, 130 which define between them above the upper body portion a channel for guiding the fasteners as they are moved along the magazine by the pusher 131. Pusher 131 is free to pivot laterally between ways 129, 130.

Pusher 131 is provided with a constant force spring (not shown) for pulling the pusher 131 along the magazine and thus urging a strip of fasteners therein forwardly toward the nosepiece and toward a fastener drive position which is located within the fastener drive channel 120 of the nosepiece 12 at the area where the magazine 13 feeds into the nosepiece 12.

Thus, for loading a strip of fasteners, it is only necessary to pull the pusher 131 rearwardly against its spring bias and to push into the rear end of the magazine through the cap 135, a strip of fasteners 17. The strip of fasteners urges aside the pivoted shoe 132 as the strip of fasteners enters the fastener channel provided by the way 129 and the way 130. After the strip of fasteners moves forwardly of the shoe 132 and the bifurcated ends 133 and 134 thereof, the shoe 132 pivots to a position directly behind the strip of fasteners so that the bifurcated ends 133 and 134 engage the last fastener in the strip. The pusher is then released and the constant force spring serves to urge the pusher 131 and the strip of fasteners 17 forwardly toward the nosepiece 12 so that the fasteners can be sequentially driven.

Finally, the magazine 13 is preferably joined to nosepiece 12 by suitable fasteners such as bolts 150, 151. The end cap 135 is secured to members 129, 130 in any suitable fashion.

It will be appreciated that when the last fastener in a strip is pushed into drive channel 120, the forward bifurcated ends 133 and 134 of the shoe 132 extend into the fastener drive position within the fastener drive channel. Thus, when the last fastener is in a position to be driven, the head 21 of such fastener could engage the forward bifurcated ends 133 and 134, damaging them or the fastener and/or jamming the tool 10.

The tool 10 incorporated means to prevent such occurrence, by providing apparatus for retracting the pusher 131 when the last fastener in a supply strip has been fed to a fastener drive position and just before the fastener is driven.

Figure 6:
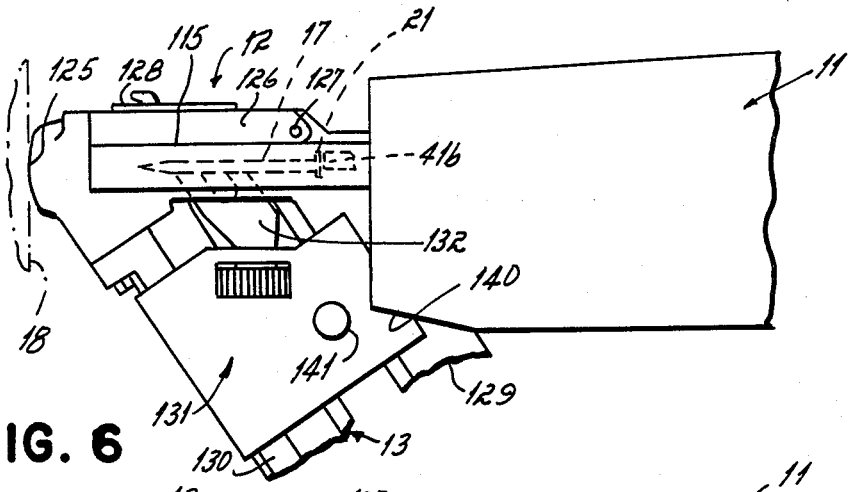
FIGS. 6–8 are illustrative views of a forward portion of the drywall tool according to the invention and showing the withdrawal of the fastener feeder shoe from the last fastener in a supply prior to driving thereof.

More specifically, the housing 11 includes a cam surface 140 (FIG. 6). A cam follower 141 is mounted on the pusher 131 in direct alignment with a cam surface 140 when the last fastener has been urged into the fastener drive channel 120.

When the handle 14 and housing 11 are pushed forwardly with respect to the nosepiece 12, the housing 11 is moved forwardly over the cam follower 141 and urges the cam follower rearwardly in the magazine to withdraw the pusher 131 and the bifurcated ends 133 and 134 of the shoe 132 from the fastener drive channel 120. This eliminates any chance that the descending fastener head 21 or driver blade **41*a*** will engage the fastener shoe. This action takes place sufficiently close to the actuation of the driver so that the final fastener does not tend to fall backwardly into the magazine.

Figure 7:
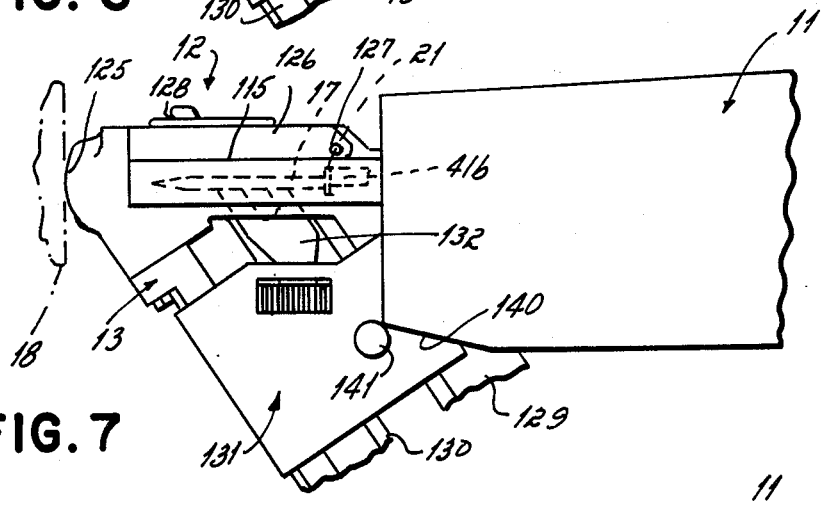
Figure 8:
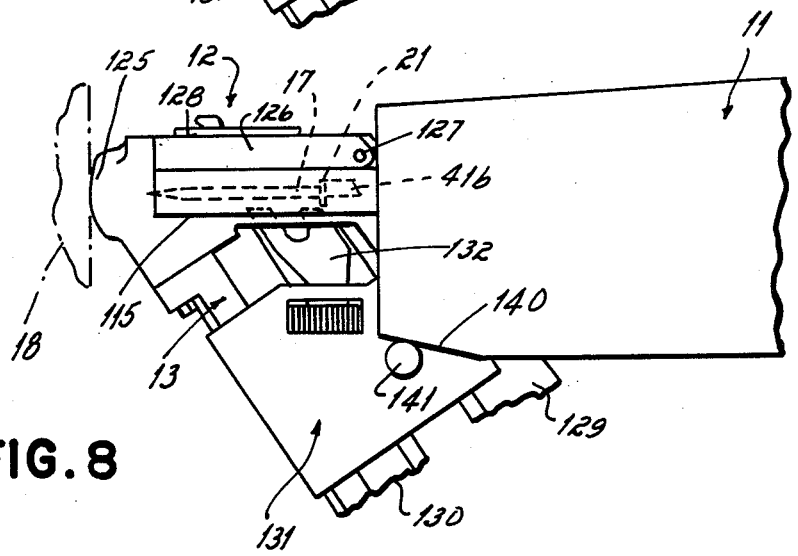

The details of the withdrawal of the pusher 131 are best seen in FIGS. 6–8. In FIG. 6, it will be appreciated that the nosepiece 12 is in a forward position and that the housing 11 has not yet been pushed forwardly. In this position, the bifurcated ends 133, 134 hold the shank of the last fastener 17 within the fastener drive channel 120. This is the last fastener in the supply and thus it will be appreciated that the cam follower 141 is in a direct line with respect to the cam surface 140. As the housing 11 is pushed forwardly to actuate the tool 10, the cam surface 140 engages the follower 141 and the follower begins to ride on the cam surface 140, pulling the pusher 131 rearwardly in the magazine. This pulls the bifurcated ends 133, 134 away from the fastener 17, as shown in FIG. 8, so its head 21 will clear them.

Having described the structure of the tool 10, the operation of the tool will now be discussed. In the preferred embodiment of the invention, high pressure air in the range of 80 to 90 psi, for example, is used. Such high pressure air is diagrammatically illustrated in the drawings as a series of dots or circles.

When the tool is in its idle or resting condition, as shown in FIG. 1, the components of the tool are not pressurized. That is to say, high pressure air exists only in the conduit 58 and up to the seat 52 in the handle 14. No pressurized air is admitted to the ports of passageways in the other components of the tool 10. In FIG. 1, some high pressure air is indicated only for the purpose of illustrating the exhausting of the expansion chamber 85 as will be described. In this position, it will be appreciated that the expansion chamber 85 is exhausted through the passageway 87 in the manifold plate 36, passageway 86 in the firing valve housing 37 and the bore portions 63 and 64, through seat 68 and into the handle 14 of the tool 10 for exhaust to the atmosphere. Furthermore, actuator rod 56 includes a channel **56*a* which cooperates with depending lug 148 in guideway 119 of housing 11 through which actuator rod 56 may reciprocate to aid in keeping nosepiece 12 from disengaging from housing 11 due to the bias of spring 116. It will be appreciated that channel 56*a* is long enough so as not to hamper or interfere with operation of the tool 10** as hereafter described.

Figure 2:
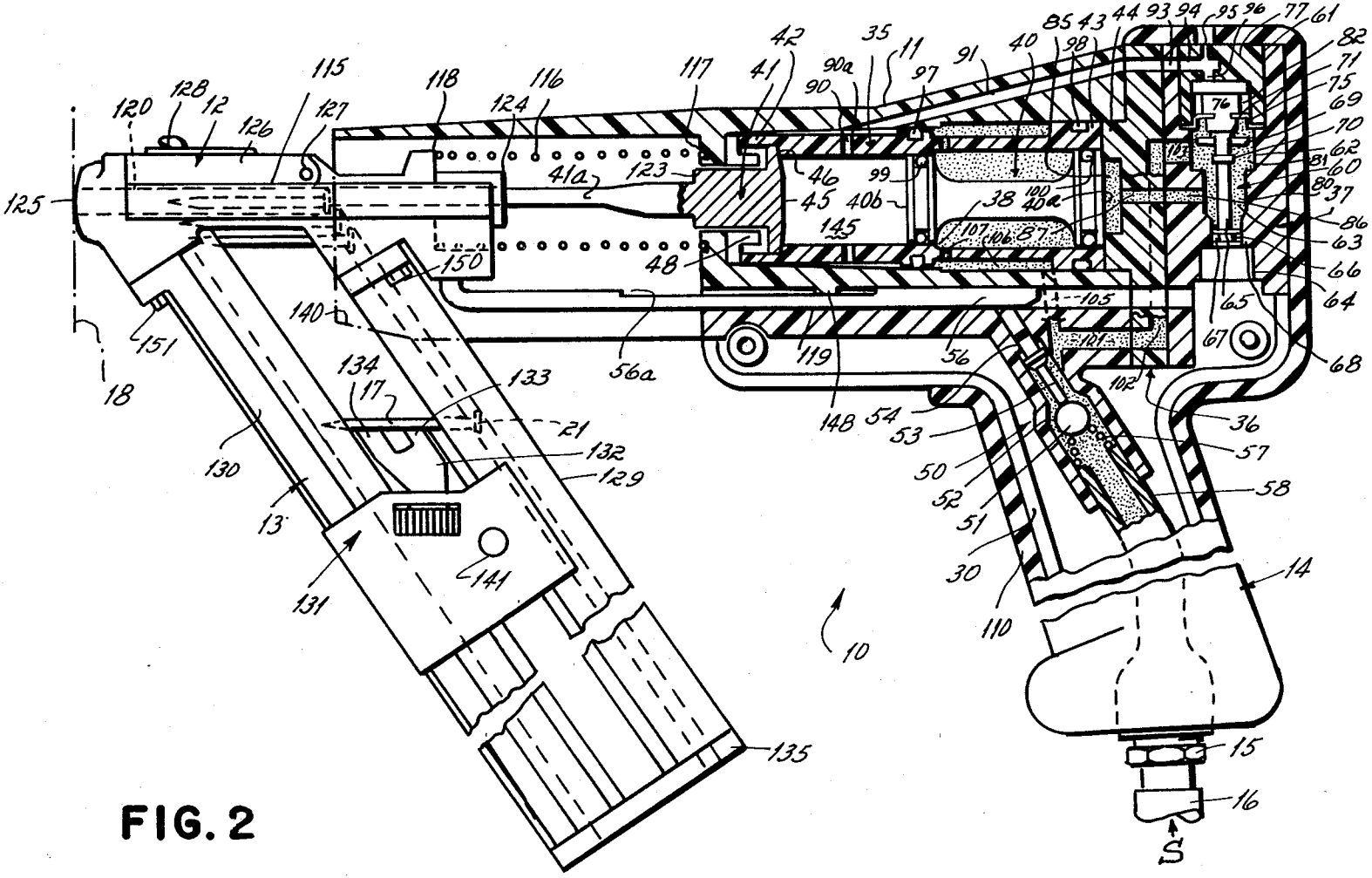
FIG. 2 is a view similar to FIG. 1, but showing the tool immediately after actuation and pressurization of the firing valve thereof.

When it is desired to drive a fastener into drywall 18 and underlying wood support structure, the tool is moved into position against the drywall as shown in FIG. 2. In this position, housing 11 is pushed forwardly over nosepiece 12 so that the stem 53 of control valve 50 is moved against rod 56. This engagement urges the stem 53 against the ball 51 and unseats the ball 51 from the seat 52. This permits a flow of pressurized air from the conduit 58, past the seat 52 and into the passageway 101, passageway 102 and passageway 103, into the second pressurized zone 81.

At this time, the translating seal 69 is still in its position as shown in FIG. 1 and prevents the pressurized air in the pressurized zone 81 from venting through the handle. At the same time, however, the pressurized zone 81 becomes an expansion chamber and the pressurized air acts against the diaphragm 75. This pressure raises the diaphragm 75 together with the valve stem 65. This upward movement of the valve stem 65 causes the O-ring seal 67 to engage bore 68 to seal off the vent. At the same time, the stop 70 is raised to life the translating seal 69 from the seat 72 and permits pressurized air to flow into the first pressurized zone 80, through zone 81. From there, the pressurized air moves through the passageway 86 in the firing valve housing 37, passageway 87 in the manifold plate 36, and into the expansion chamber 85 behind the piston 40. This pressurization drives the piston 40 forwardly, or to the left as viewed in FIG. 2, until the forward end of the piston face **40*b* strikes the strike surface 45 of the driver 41, driving the driver forwardly as shown in FIG. 3**.

It will be appreciated that the piston stroke is approximately 1-$\frac{1}{8}$", while the driver stroke as a result of the piston strike is only about 1/16" in length before the driver 41 engages the annular stop 48.

At the same time as pressurized air is admitted past the seat 52 of the control valve 50, pressurized air also moves through the passageway 105 into the recess 106, surrounding the cylinder 35, and to the ports 107. This air fills a piston chamber 145 between the ends **40*a* and 40*b* of the piston 40. In FIG. 2, this pressurized air is also represented by a number of small dots or circles shown within the respective passageways. Thus, as the expansion chamber 85 is pressurized to drive the piston forwardly, the piston chamber 145** surrounding the piston and between its ends is also pressurized.

Figure 3:
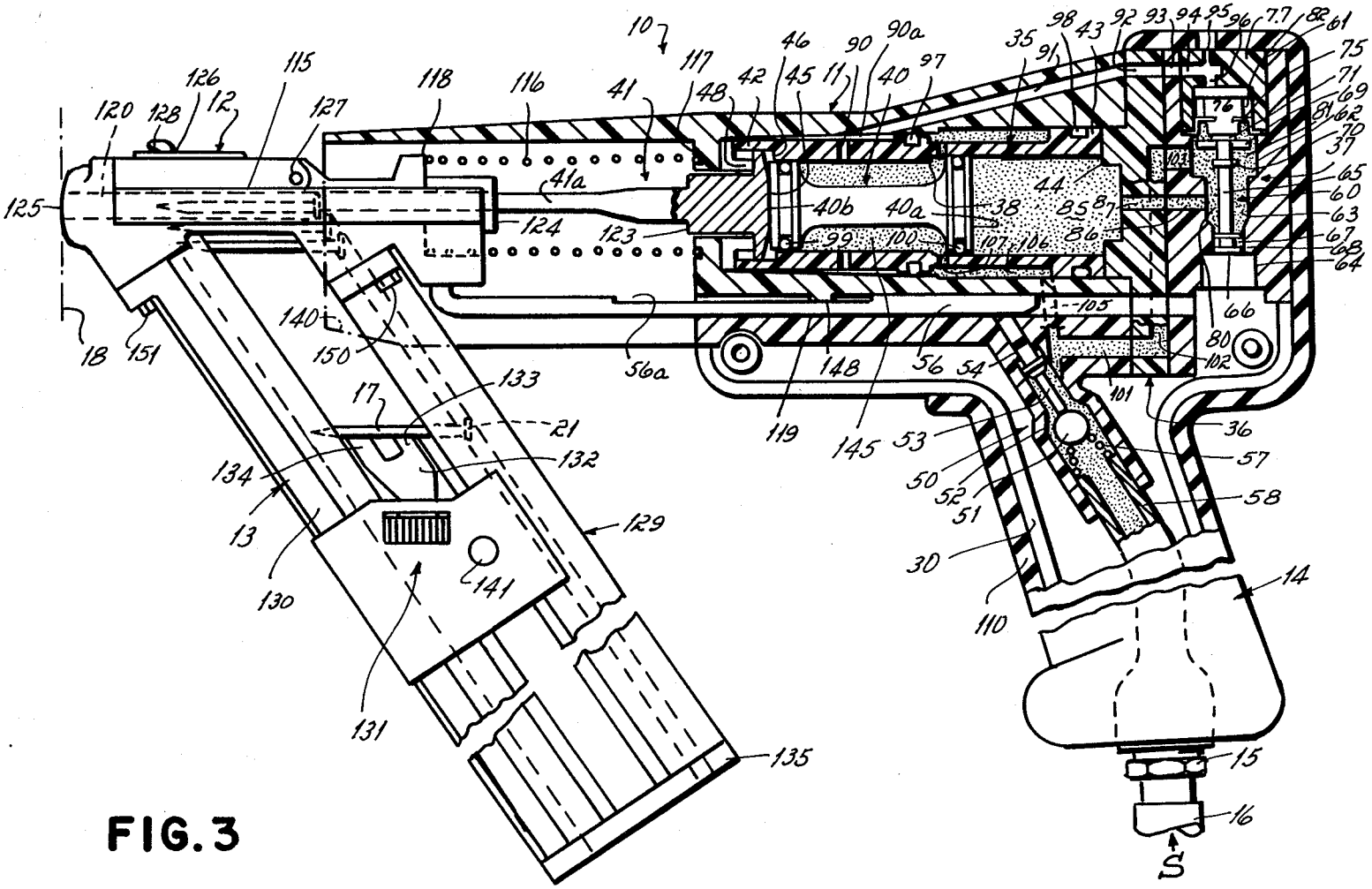
FIG. 3 is a view similar to FIG. 1, but showing the tool at the end of the first driving stroke of the piston.

Turning now to FIG. 3, the piston 40 has moved forwardly to engage the driver 41 and drive it forwardly through its short stroke against the annular stop 48. Also, it will be appreciated that the whole housing 11 has been moved forwardly with respect to the nosepiece 12 such that the driver 41 has been moved into a position proximate the head 21 of the fastener 17 within the fastener drive channel 120. This motion pushes fastener 17 down drive channel 120 until its point engages the drywall 18. Accordingly, when the piston 40 strikes the driver 41, the forward end **41*b* of the driver 41 engages the fastener head 21 to urge it forwardly a slight distance which is much shorter than the overall fastener length. It is thus not possible to drive the fastener very deeply as a result of this single piston strike in view of the very limited stroke of the driver 40. As shown in FIG. 3, it will be appreciated that the driver 41 has been moved only slightly forwardly of the rearward stop shoulder 46 of the cylinder adjacent to which the driver 41** is mounted.

Also, it should be noted that the nosepiece is biased against the drywall 18 by means of spring 116. This is an insufficient force to produce a dimple or any tearing.

Once the piston 40 has reached its forwardmost position, as shown in FIG. 3, it will be appreciated that the chamber 145 has also moved forwardly in the cylinder and is now communicating with the ports 90 and the recess **90*a* surrounding the cylinder and between the cylinder and the housing 11. The recess 90*a* communicates with the passageway 91 to pressurize that passageway as shown in FIG. 4**.

It will also be appreciated that pressurized air continues to pressurize the piston chamber 145 through the passageway 105 and the ports 107 which are still in communication with the chamber 145.

The pressurized air thus is conveyed through the passageway 91 in housing 11 to the passageway 92 in manifold plate 36 and the passageway 93 in the valve actuator housing 37. Passageway 93 connects with passageway 94 in the ported cap 77. Here, the pressurized air is partially vented through the vent passage 95 while a larger portion of the pressurized air is moved through the passageway 96 into the third pressurized chamber 82. The pressure exerted in the third pressurized zone 82 is substantial enough to drive the diaphragm 75 downwardly and thus move the valve stem 65 in a downward direction. The translating seal 69, however, is not yet forced down to engage the seat 72 to seal the second pressurized zone 82 from the zone 80. At the same time, the lower end of the valve stem 65 is moved downwardly so that the seat 67 clears the bore 68. This permits the pressurized air within the bore portion 63 to exhaust through that seat and into the handle 14 (as diagrammatically illustrated in FIG. 1). This effectively communicates the expansion chamber 85, through passageways 87, 86 and bore portions 63 and 64 with atmosphere and vents the expansion chamber. Some pressurized air in zone 81 also vents past seat 72 at this time.

Figure 4:
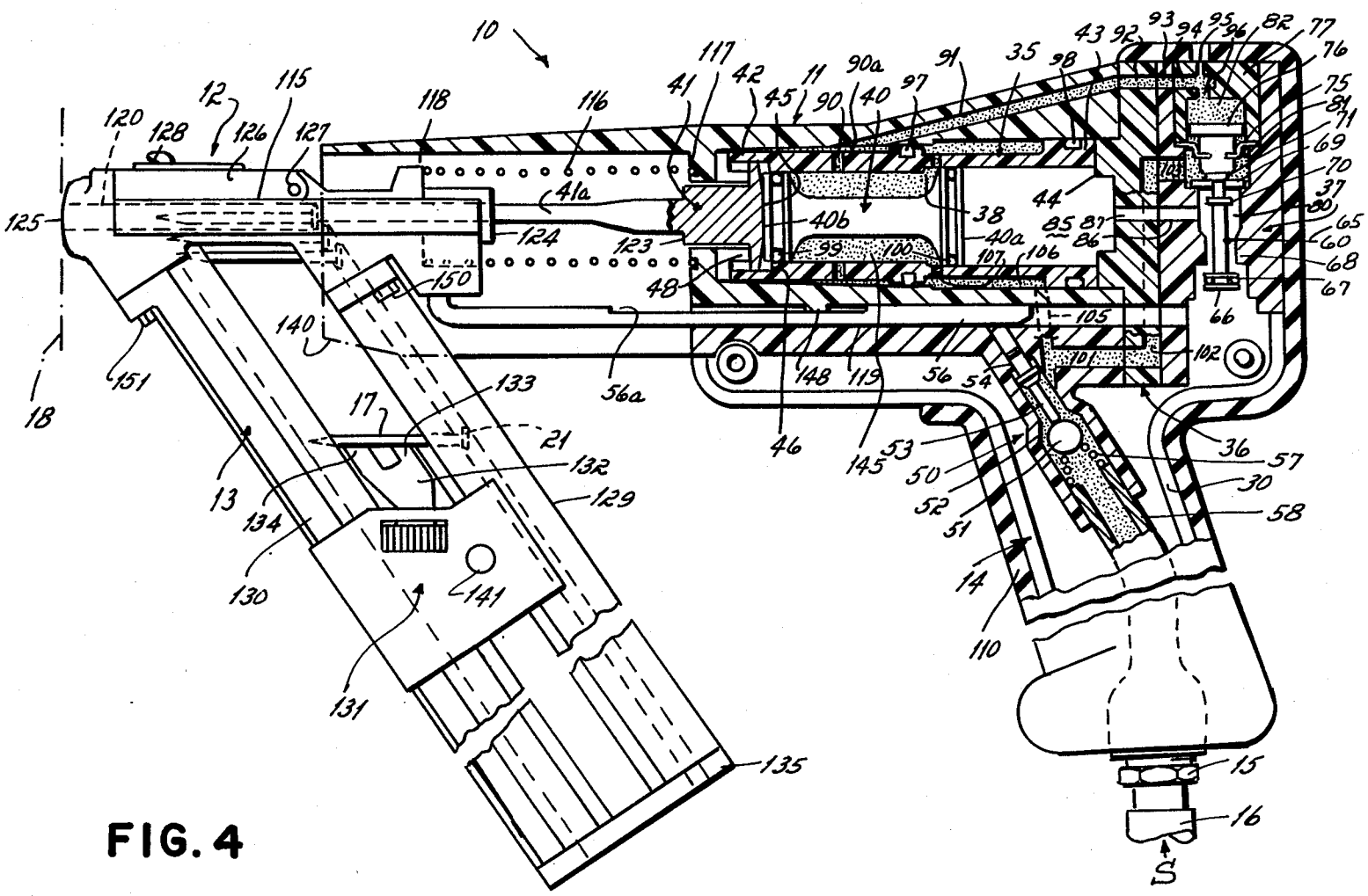
FIG. 4 is a view similar to FIG. 1, but showing the tool immediately after reversal of the firing valve while the piston is still in its forwardmost position at the end of its first stroke.

When the expansion chamber 85 is exhausted, as indicated in FIG. 4, it must be appreciated that pressure still exists within the piston chamber 145. Because piston chamber 145 is now disposed wholly within the portion of cylinder 35 having a diameter A, further introduction of pressurized air into chamber 145 will cause piston 40 to move rearwardly as chamber 145 seeks the larger volume available in the portion of cylinder 35 having the larger diameter B. Thus, piston 40 is driven rearwardly toward its initial position, as shown in FIG. 1.

At the same time, continued air pressure is exerted through the passageways 101, 102, and 103 since the housing 11 is still forced toward nosepiece 12 and rod 56 has pushed stem 53 to hold open valve 50. This continues to attempt to fill the second pressurized zone 81.

Seal 69 is urged downwardly against the seat 72 by stop 71 upon continued downward motion of stem 65. As soon as the translating seal 69 engages the seat 72, the second pressurized zone 81 is sealed, while expansion chamber 85 is still vented. Pressure build-up in zone 81 then urges the diaphragm 75 upwardly, moving the valve stem 65 in an upward direction to seal off the bore 68. The second pressurized zone 81 continues to remain pressurized despite this upward movement as a result of the distance between the stops 70 and 71. Translating seal 69 remains in seat 72 until seal 69 is engaged by stop 70. This permits the sealing at the seat 68 and the cutting off of any communication of expansion chamber 85 with the atmosphere prior to the time that pressurized air through the second pressurized zone 81 is again directed to the expansion chamber 85 through the passageways 86 and 87. An intermediate condition of the firing valve 60 during the time the piston is returning to its start position is diagrammatically shown for illustrative purposes in FIG. 5.

The piston driving cycle is then automatically repeated with the piston reciprocating forwardly and backwardly and the pneumatic circuitry operating in the aforedescribed manner. The operation of the firing valve 60 together with that of the other components of the tool 10 thus serves to reciprocate the piston 40 within the cylinder 35 with repeated strokes to repeatedly strike the driver 41 and thus repeatedly drive the fastener 17 into drywall and underlying wood support, but with very short driver strokes. Preferably, the piston is cycled at about 25–30 Hz.

As the piston cycling is continued, the fastener is driven into the drywall 18 and wood support 19 until the housing 11 has been pressed forwardly toward the nosepiece to the approximate position as shown in FIG. 5. Assuming continued operator pressure, housing 11 moves toward drywall 18 as fastener 17 is driven.

It will be appreciated that during the aforementioned operation, the dimpling or drive shoulder 123 of the driver 41 has not engaged the dimpling drive surface 124 of the nosepiece 12. Nevertheless, as the housing 11 nears the nosepiece 12, such as illustrated in FIG. 5, the driver shoulder 123 engages the dimpling drive surface 124 of the nosepiece and serves to drive the dimpling surface 125 into the drywall, thereby creating a depression or dimple 20 for receipt of the head 21 of the fastener 17. In this manner, the dimpling operation of the tool 10 is delayed until the final blows of the driver 41 for finally setting the fastener 17. Thus, the final setting of the fastener 17 is combined with the dimpling of the drywall 18.

This entire operation provides a tactile and audible feedback to the user, as will be hereinafter described, to permit the user to avoid driving the fastener too deeply, such as to tear the paper facing 23 of the drywall 18, while, at the same time, assuring complete fastener driving into the dimple 20.

It will also be appreciated that by the structure above described, the driver directly engages the nosepiece for direct impact to produce the dimpling of the drywall 18 and there are no resilient buffers or bumpers between the driver and the nosepiece to cushion this dimpling process, nor are any needed as a result of the very short stroke of the driver 41.

At the same time as the housing 11 moves forwardly, it will be appreciated that if the fastener 17 is the last fastener to be driven (see FIGS. 6–8), the cam surface 140 of the housing 11 will engage the cam follower 141 of the pusher 131 to withdraw the shoe 132 and its bifurcated ends 133 and 134 from the last fastener in order to avoid damage to the shoe 132 by either the fastener head 21 or the tip of the driver blade **41*b***.

During fastener driving, the tool 10 produces tactile and audible feedback sensations to the user to enable him to know the fastener position and to withdraw the tool once the fastener is fully set, and the dimple formed, all without tearing or damaging the drywall. The frequency of driver strokes together with their short length give the user a feel and sound constantly indicative of the fastener position. A user can feel the fastener being driven through drywall, and then the underlying support. As the head 21 of the fastener 17 engages the drywall 18 and the dimple 20 is formed, the feel and sound change, indicating the proper fastener position. The user then pulls the handle 14 away from drywall 18, immediately removing driver 41 from any further contact with fastener 17 or nosepiece 12 to avoid overdriving of fastener 17 and any tearing of the drywall.

Only a slight rearward movement is sufficient in view of the limited driver stroke. While the nosepiece may remain in contact with drywall 18 for some additional time as handle 14 is withdrawn, it is not driven and does not impart any undesirable force to the drywall 18.

Moreover, it will be appreciated that the frequency of driver strokes provides constant sensory feedbacks to the user so that the entire fastener driving operation can be monitored and adapted to the circumstances or material characteristics at any point in the fastener driving cycle.

For example, if any underlying wood support is missed, the user can feel this and eliminate overdriving the fastener 17. Also, a user can determine by these feedbacks the hard or soft characteristics of the wood support 19, and withdraw the tool 10 when desired after proper fastener setting.

It should also be appreciated that the position of the housing 11, with respect to nosepiece 12, indicates the position of a fastener 17 as it is driven and provides a further feedback for control.

With the short driver strokes, the overall drive velocity of a fastener 17 is substantially reduced as compared, for example, to a single blow apparatus. The fastener 17 thus does not tend to damage wood fibers as a fastener driven by a single blow, and the wood support 19 tends to hold a fastener 17 more securely when it has been driven by the tool 10 as compared to single blow devices.

Of course, this operation is extremely simple for a user after only a little practice to become acquainted with the appearance, sound and feel of the tool during fastener driving. There is no trigger to worry about, and once the housing 11 is withdrawn rearwardly, carrying driver 41 with it away from the nosepiece, a new fastener is urged into drive channel 120 for a quick repeat operation.

Thus the tool 10 requires no adjustment during application to account for a particular type of drywall, underlying wood, or the event of a miss. The user readily and easily accommodates these variations during each drive, by simply pulling the tool 10 away from the drywall when the tool feedbacks indicate the fastener is properly driven, regardless of these variations.

These and other modifications and advantages will become readily apparent to those of ordinary skill in the art without departing from the scope of the invention and applicant intends to be bound only by the claims appended hereto.

We claim:

1. A drywall tool for uniformly dimpling drywall having a facing component and uniformly driving full-headed fasteners into such drywall and supporting wood structure despite varying wood structure characteristics, such that said full heads uniformly lie in a dimpled area of drywall, without tearing any drywall facing component, said tool comprising:

a housing;

a nosepiece slidably mounted on said housing for movement toward said housing;

a magazine means for feeding full-headed fasteners sequentially to a drive position within said nosepiece, said magazine means mounted on said slidable nosepiece;

a driver means mounted to deliver successive limited stroke blows to a fastener, each blow driving a fastener a distance less than its length;

piston means independent of said driver;

means for reciprocating said piston to successively engage and stroke said driver for driving said fastener;

a dimpling surface integral with said nosepiece and movable therewith for creating a dimple in drywall upon final driving of a fastener;

a drive surface on said nosepiece; and a drive shoulder on said driver means for engaging said drive surface, when said driver means has substantially driven said driver, to produce a dimple in said drywall for receipt of the full head of said fastener;

said limited successive driver strokes providing, during fastener driving and dimple forming, tactile and audible feedback to indicate fastener position and dimple depth with respect to said drywall.

2. A drywall tool as in claim 1, further including spring means constantly biasing apart the nosepiece and housing.

3. A drywall tool for driving fasteners to fasten drywall to supporting structure and comprising:

a housing;

a nosepiece mounted on said housing and being slidable with respect thereto for movement toward said housing;

a magazine means for feeding individual fasteners sequentially to a drive position in said nosepiece for driving, said magazine means mounted on said nosepiece;

a reciprocable driver mounted for engaging and driving a fastener from said drive position in said nosepiece into drywall and supporting structure, said driver being reciprocably movable with respect to said nosepiece;

a piston movable with respect to said driver; and means for reciprocating said piston to strike said driver with successive blows for driving said fastener into said drywall and supporting structure with successive driver strokes, each stroke having a length shorter than the length of said fastener;

wherein said nosepiece includes an integral dimpling drive surface on a forward end thereof and movable therewith and an integral dimpling drive surface on a rearward end thereof, and wherein said driver includes an elongated fastener driving blade having a forward end for engaging and driving fasteners, and a dimpling drive shoulder disposed rearwardly of said forward end for engaging said dimpling drive surface of said nosepiece to produce a dimple in said drywall as said fastener is finally driven, and;

said short successive driver strokes providing, during driving, tactile and audible feedback to indicate fastener and dimpling surface position with respect to said drywall.

4. A drywall tool as in claim 3, wherein said dimpling drive surface of said driver is spaced rearwardly thereon a sufficient distance from said forward end of said driver blade such that said nosepiece is not struck by said driver until said fastener is substantially completely driven.

5. A drywall tool as in claim 3, further including spring means constantly biasing apart the nosepiece and housing.

6. Apparatus for driving a nail or the like of predetermined length into a workpiece by successive blows and adapted to create an impression in the workpiece comprising:

a housing;

a nosepiece slidably mounted on the housing for movement toward said housing and adapted to receive a nail and having drive channel means for guiding the nail as it is driven into the workpiece, the nosepiece further having an integral forward dimpling surface movable therewith and to be pressed against the workpiece and a non-resilient rear surface;

driver means mounted in said housing and disposed rearwardly of the rear surface of the nosepiece, and movable with respect thereto, and said driver means having a forward projection at least a portion of which is slidably mounted to reciprocate within the drive channel means with a predetermined stroke length for driving a nail into the workpiece by successive blows, the driver means further having a nonresilient forward surface rigidly mounted radially and rearwardly of the forward projection and opposing the rearward surface of the nosepiece;

the driver means having a first position relative to the nosepiece wherein the forward surface of the driver means is spaced apart from the rearward surface of the nosepiece a predetermined distance and the forward projection is spaced apart from the head of the nail a distance greater than its stroke length;

the driver means further having a second position relative to the nosepiece wherein the nail is driven out of the drive channel and into the workpiece and the opposing surfaces are spaced apart less than the distance of the forward projection stroke length such that further blows of the driver means transmits force to the nosepiece front surface, impressing the front surface into the workpiece.

7. Apparatus as in claim 6, further including spring means constantly biasing apart the nosepiece and housing.

8. The apparatus of claim 6, wherein the length of the drive channel means is longer than the predetermined length of the nail.

9. The apparatus of claim 8, wherein the length of the forward projection is approximately equal to the length of the drive channel means.

10. The apparatus of claim 9, wherein the stroke length of the forward projection is substantially less than the length of the drive channel means.

11. The apparatus of claim 10, further including bias means for urging the driver means to the first position.

12. The apparatus of claim 11, wherein said driver means is pneumatically operated, said apparatus further including:

a control valve selectively operable to permit passage of pneumatic pressure; and actuator means on said nosepiece for actuating said control valve.

13. The apparatus of claim 12, wherein said control valve is mounted on the driver means, said apparatus further including:

an actuator rod for slidably engaging the control valve when said nosepiece is moved toward said housing;

the actuator rod mounted to and projecting rearwardly of the nosepiece wherein as the driver means is urged from the first position to the second position by a forwardly applied external force, causing relative movement between the housing and nosepiece, the actuator rod engages and actuates the control valve.

14. A pneumatic fastener drive apparatus for driving a nail or the like into a workpiece by successive blows and adapted to create a dimple in the workpiece, comprising:

a housing;

a nosepiece mounted on and movable toward the housing and having drive channel means for receiving and guiding the nail as it is driven into the workpiece, the nosepiece further having a forward integral dimpling surface to be pressed against the workpiece and a non-resilient rear surface;

a driver assembly in said housing rearwardly of the nosepiece;

the driver assembly including first reciprocating driver means having a forward projection at least a portion of which is slidably mounted to reciprocate within the drive channel means, and with respect to said nosepiece, with a first predetermined stroke length for driving a nail into the workpiece by successive blows and further having a nonresilient forward surface rigidly mounted radially and rearwardly of the forward projection and opposing the rear surface of the nosepiece;

the driver assembly further including a piston with a second predetermined stroke length for repeatedly engaging the first driver means whereby the first driver means repetitively engages the head of the nail with successive blows;

a pneumatic pressure responsive firing valve assembly operable to continuously reciprocate the second driver means;

the driver assembly having a ready position relative to the nosepiece wherein the driver means forward surface is spaced apart from the nosepiece rear surface a predetermined distance and the forward projection is spaced apart from the head of the nail a distance greater than its stroke length;

the driver assembly having a driving position relative to the nosepiece when the nosepiece is moved toward said housing wherein the forward projection is spaced apart from the head of the nail a distance less than its stroke length to repeatedly drive the nail into the workpiece and the driver means forward surface is spaced apart from the nosepiece rear surface a distance greater than the forward projection stroke length;

the driver assembly further having a driven position relative to the nosepiece wherein the nail is driven out of the drive channel means and into the workpiece and the opposing surfaces are spaced apart less than the distance of the forward projection stroke length such that further blows of the driver means transmits force to the nosepiece front surface, impressing the front surface into the workpiece; and nail feeder means for feeding one of a plurality of nails into the nosepiece when the driver assembly is in the ready position.

15. A pneumatic fastener drive apparatus as in claim 14, further including spring means constantly biasing apart the nosepiece and housing.

16. The pneumatic fastener drive apparatus of claim 14, wherein the second predetermined stroke length is substantially longer than the first predetermined stroke length.

17. The pneumatic fastener device apparatus of claim 16, further including bias means for urging the driver assembly to the ready position.

18. The pneumatic drive apparatus of claim 16, further including:

a control valve selectively operable to permit passage of pneumatic pressure; and actuator means extending rearwardly from said nosepiece for actuating said control valve.

19. The pneumatic fastener drive apparatus of claim 18, wherein said control valve is mounted on the driver assembly, said actuator means further including:

an actuator rod for slidably engaging the control valve, the actuator rod mounted to and projecting rearwardly of the nosepiece wherein as the driver assembly is urged from the ready position to the driving position by a forwardly applied external force, the actuator rod engages and actuates the control valve.

20. A pneumatic fastener drive apparatus as in claim 16, for driving a fastener into drywall and a supporting member, wherein the second predetermined stroke length is about 1-$\frac{1}{8}$ inches in length.

21. A pneumatic fastener drive apparatus as in claim 16 for driving a fastener into drywall and a supporting member, wherein the first predetermined stroke length is about 1/16 inch in length.

22. A pneumatic fastener drive apparatus as in claim 16 for driving a fastener into drywall and a supporting member, wherein the first predetermined stroke length is about 1/16 inch in length and the second predetermined stroke length is about 1-$\frac{1}{8}$ inches in length.

23. The pneumatic fastener drive apparatus of claim 22, wherein said piston reciprocates at a frequency of about 25–30 Hz.

24. The pneumatic fastener drive apparatus of claim 8, wherein the firing valve assembly includes:

a first pressure zone;

a second pressure zone;

a sealable vent;

first movable seal means for sealing the first pressure zone from the second pressure zone;

second movable seal means for sealing the first pressure zone from the sealable vent;

duct means for passage of pressurized air from the first pressure zone to an expansion chamber disposed above the piston.

25. The pneumatic fastener drive apparatus of claim 24, wherein said first and second movable seals have a first position wherein the first pressure zone is sealed from the second pressure zone and the first pressure zone is vented, said apparatus further including:

first pneumatic circuit means for pressurizing the second zone and for moving the first and second movable seals to a second position, thereby sealing the sealable vent and permitting pressurized air to pass from the second zone to the first zone and into the expansion chamber via the duct means to drive the piston downwardly through a first stroke in a cycle; and second pneumatic circuit means operable during movement of the piston to the end of the first stroke for moving the first and second movable seals to the first position to interrupt the passage of pressurized air between the first pressure zone and the second pressure zone, and to vent the first zone thereby venting the expansion chamber via said duct means, the second pneumatic circuit means further operable to return the piston through a second stroke.

26. The pneumatic fastener drive apparatus of claim 25, wherein the firing valve assembly further includes a third pressure zone and a permanent seal between the second and third pressure zone;

the permanent seal operatively connected with the first and second movable seals to urge them to the first position such that when the first and second movable seals are in the second position, pressurizing the third pressure zone deflects the permanent seal to urge the first and second movable seals to the first position.

27. The pneumatic fastener drive apparatus of claim 26, wherein the piston is double-ended with a piston chamber interposed between the ends;

the first pneumatic circuit means further operable to provide a pressurized air to the constant piston; and portion means for communicating pneumatic air from the piston chamber to the third pressure chamber during movement of the piston to the end of the first stroke.

28. The pneumatic fastener drive apparatus of claim 26, wherein the firing valve assembly includes:

a first pressure chamber;

a second pressure chamber;

a sealable vent;

a valve stem portion having a first position and a second position including a first seal means movable on, and with respect to, the valve stem portion for selectively sealing the first pressure chamber from the second pressure chamber when the valve stem portion is in the first position, the valve stem portion further including a second seal means movable with the valve stem portion for selectively sealing the first pressure chamber from the sealable vent when the valve stem portion is in the second position.

29. A pneumatic fastener drive apparatus of claim 28, wherein the firing valve assembly further comprises:

a third pressure chamber;

a third seal mounted on the valve stem portion between the second and third pressure chambers and permanently sealing them, the third seal urging the valve stem portion to the first position.

30. The pneumatic fastener drive apparatus of claim 29, further including:

duct means for passing pressurized air from the first pressure chamber fo the expansion chamber;

pneumatic circuit means operable upon expansion of the expansion chamber to provide pressurized air to the third pressure chamber whereby the valve stem portion is urged from the second position to the first position.

31. The pneumatic fastener drive apparatus of claim 30, whereby operation of the pneumatic circuit means causes the first chamber in the expansion camber to vent and further causes the expansion chamber to contract.

32. A drywall tool for uniformly dimpling drywall having a facing component and uniformly driving full-headed fasteners into such drywall and supporting wood structure despite varying wood structure characteristics, such that said full heads uniformly lie in a dimpled area of drywall, without tearing any drywall facing component, said tool comprising:

a housing;

a nosepiece slidably mounted on, and movable toward, said housing;

a magazine means for feeding full-headed fasteners sequentially to a drive position within said nosepiece, said magazine means mounted on said slidable nosepiece;

a driver means mounted to deliver successive limited stroke blows to a fastener, each blow driving a fastener a distance less than its length, said driver means being movable with respect to said nosepiece;

piston means independent of said driver;

means for reciprocating said piston means to successively engage and stroke said driver for driving said fastener upon movement of said housing and nosepiece toward one another;

a dimpling surface integral and movable with said nosepiece;

a drive surface on said nosepiece;

a drive shoulder integral with said driver means for engaging said drive surface, when said driver means has substantially driven said driver, to produce a dimple in said drywall for receipt of the full head of said fastener;

said limited successive driver strokes providing, during fastener driving and dimple forming, tactile and audible feedback to indicate fastener position and dimple depth with respect to said drywall; and wherein said means for reciprocating said piston means includes a firing valve assembly for use in repeated delivery of pressurized air to an expansion chamber above said piston means and comprising:

a first pressure zone;

a second pressure zone;

a sealable vent;

first movable seal means for sealing the first pressure zone from the second pressure zone;

second movable seal means for sealing the first pressure zone from the sealable vent;

duct means for passage of pressurized air from the first pressure zone to the expansion chamber;

said first and second movable seals having a first position where the first pressure zone is sealed from the second pressure zone and the first pressure zone is vented;

first pneumatic circuit means for pressurizing the second zone and for moving the first and second movable seals to a second position, thereby sealing the sealable vent and permitting pressurized air to pass from the second zone to the first zone and into the expansion chamber via the duct means to drive the piston means downwardly through a first stroke in a cycle; and second pneumatic circuit means operable during movement of the piston means to the end of the first stroke for moving the first and second movable seals to the first position to interrupt the passage of pressurized air between the first pressure zone and second pressure zone, and to vent the first zone, thereby venting the expansion chamber via said duct means, the second pneumatic circuit means further operable to return the piston means through a second stroke.

33. A drywall tool as in claim 32, further including spring means constantly biasing apart the nosepiece and housing.

* * * * *

UNITED STATES PATENT AND TRADEMARK OFFICE

CERTIFICATE OF CORRECTION

PATENT NO. : 4,610,381

DATED : September 9, 1986

INVENTOR(S) : Kramer et al.

It is certified that error appears in the above-identified patent and that said Letters Patent is hereby corrected as shown below:

Column 20, line 33, "fo" should be --to--

Column 20, line 41, "camber" should be --chamber--

Signed and Sealed this

Twenty-eighth Day of April, 1987

*Attest:*

DONALD J. QUIGG

*Attesting Officer*

*Commissioner of Patents and Trademarks*